US006623270B1

(12) United States Patent
Meldeau

(10) Patent No.: US 6,623,270 B1
(45) Date of Patent: Sep. 23, 2003

(54) ABDOMINAL EXERCISE DEVICE WITH LUMBAR SUPPORT

(76) Inventor: William Brent Meldeau, 18685 Main St., Suite 434, Huntington Beach, CA (US) 92648

( * ) Notice: Subject to any disclaimer, the term of this patent is extended or adjusted under 35 U.S.C. 154(b) by 19 days.

(21) Appl. No.: 10/012,643

(22) Filed: Nov. 13, 2001

(51) Int. Cl.[7] ..... F27B 9/22
(52) U.S. Cl. ..... 432/140
(58) Field of Search ..... 482/140, 148; 297/452.1; 54/66; 5/500, 624, 632–633; 2/224, 20; 601/84, 24, 134; D24/215; 604/358

(56) References Cited

U.S. PATENT DOCUMENTS

| | | | | | |
|---|---|---|---|---|---|
| 1,904,039 | A | * | 4/1933 | Bruder | 482/140 |
| D233,200 | S | * | 10/1974 | Madl | D6/201 |
| D236,287 | S | * | 8/1975 | McNair | D83/1 S |
| D246,816 | S | * | 1/1978 | Tam et al. | D6/201 |
| D247,209 | S | * | 2/1978 | Woog | D6/201 |
| 4,210,322 | A | * | 7/1980 | Pritchard | 272/109 |
| 4,230,099 | A | * | 10/1980 | Richardson | 128/69 |
| D263,439 | S | * | 3/1982 | Grube | D6/201 |
| 4,350,152 | A | * | 9/1982 | Strakowski | 128/24 R |
| 4,383,342 | A | * | 5/1983 | Forster | 5/432 |
| D271,647 | S | * | 12/1983 | McLeod | D6/201 |
| 4,421,110 | A | * | 12/1983 | DeLisle et al. | 128/60 |
| 4,535,495 | A | * | 8/1985 | Oldfield | 5/432 |
| D282,990 | S | * | 3/1986 | Sims et al. | D6/601 |
| D284,032 | S | * | 5/1986 | Wahl et al. | D6/502 |
| D288,632 | S | * | 3/1987 | Grimsrud | D6/360 |
| 4,752,067 | A | | 6/1988 | Colonello | |
| 5,015,037 | A | * | 5/1991 | Giblin et al. | 297/452 |
| 5,147,267 | A | * | 9/1992 | Kunewalder | 482/142 |
| D342,411 | S | * | 12/1993 | Graebe | D6/601 |
| 5,273,510 | A | | 12/1993 | Puckett et al. | |
| 5,368,537 | A | | 11/1994 | Felice | |
| 5,431,618 | A | * | 7/1995 | Levi | 482/142 |
| 5,474,513 | A | * | 12/1995 | Carlesimo et al. | 482/140 |
| 5,584,786 | A | * | 12/1996 | Almeda | 482/142 |
| 5,611,765 | A | * | 3/1997 | Koch | 482/142 |
| 5,647,829 | A | * | 7/1997 | Rivas | 482/142 |
| D385,741 | S | | 11/1997 | Lebenbaum | |
| 5,722,923 | A | * | 3/1998 | Lui | 482/140 |
| 5,755,647 | A | * | 5/1998 | Watnik | 482/121 |
| 5,882,284 | A | | 3/1999 | Cayne | |
| 5,987,675 | A | * | 11/1999 | Kim | 5/632 |
| 6,336,895 | B1 | * | 1/2002 | Dukes | 482/140 |

FOREIGN PATENT DOCUMENTS

| | | |
|---|---|---|
| WO | WO 96/36401 | 11/1996 |

* cited by examiner

*Primary Examiner*—Nicholas D. Lucchessi
*Assistant Examiner*—Lori Baker Amerson
(74) *Attorney, Agent, or Firm*—James G. O'Neill; Klein, O'Neill & Singh

(57) ABSTRACT

An abdominal exercise device has an elongated body with a first seating end having a tailbone pad mounted thereon, adjacent a raised second lumbar support end. The lumbar support end has a multi-curved upper surface, including a concave portion between raised side rails that conforms to the lumbar region of a person's body to allow the person to achieve a better, more comfortable workout, with accelerated and improved results.

14 Claims, 2 Drawing Sheets

ABDOMINAL EXERCISE DEVICE WITH LUMBAR SUPPORT

BACKGROUND OF THE INVENTION

1. Field of the Invention

This present invention relates generally to exercise devices, and more particularly, to an improved abdominal exercise device having a radiused lumbar support to prevent subluxation of the spine and contribute to a better and more comfortable workout.

2. Description of Related Art

As is well known, strong abdominal muscles are desirable for aesthetic and health reasons. Therefore, many persons perform "crunches" or sit-ups while lying flat on the floor or a mat to strengthen their abdominal muscles. This form of exercise, however, puts strain on the lower back and can result in injury if not performed properly.

To overcome this problem, numerous devices have been developed for use by a person while exercising, including devices for use while performing "crunches" or sit-ups. Examples of such exercise devices are disclosed in U.S. Pat. Nos. D385,741, D407,256, 1,904,039, 4,752,067, 5,273,510, 5,431,618, 5,474,513, 5,647,829 and 5,882,284; as well as International Patent publication WO 96/36401.

However, none of these known devices appear to have met with commercial success. This is probably due to the fact that the known devices do not properly support the lumbar region of the back or are unduly complex and not easy to use. Furthermore, many of the known devices are too bulky and expensive.

Therefore, there still exists a need in the art for an exercise device to strengthen the abdominal muscles that is inexpensive, effective and easy to use, and that supports the back while providing a better and more comfortable workout, which produces improved results.

SUMMARY OF THE INVENTION

Accordingly, it is a general object of the present invention to provide an improved and simplified exercise device. It is a particular object of the present invention to provide an improved and simplified abdominal exercise device. It is a further particular object of the present invention to provide an improved and simplified abdominal exercise device having a radiused lumbar support. And, it is yet a further particular object of the present invention to provide an improved and simplified exercise device having a compound-curve lumbar support with side rails to increase pressure on the abdominal muscles to provide an improved workout.

These and other objects of the present invention are achieved by providing an abdominal exercise device having a body with a flat front extending portion including a tailbone pad, secured to a raised rear portion having a compound-curve lumbar support with raised side rails, which device provides better and more comfortable back support to a user to thereby provide an accelerated abdominal muscle workout that produces superior results.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

FIG. 2 is a side cross-sectional view of the device of the present invention resting on a flat surface, with a person, shown in broken line, lying in a supine position thereon to start an abdominal crunch, sit-up, or the like;

DESCRIPTION OF THE PREFERRED EMBODIMENTS

Figure 1:
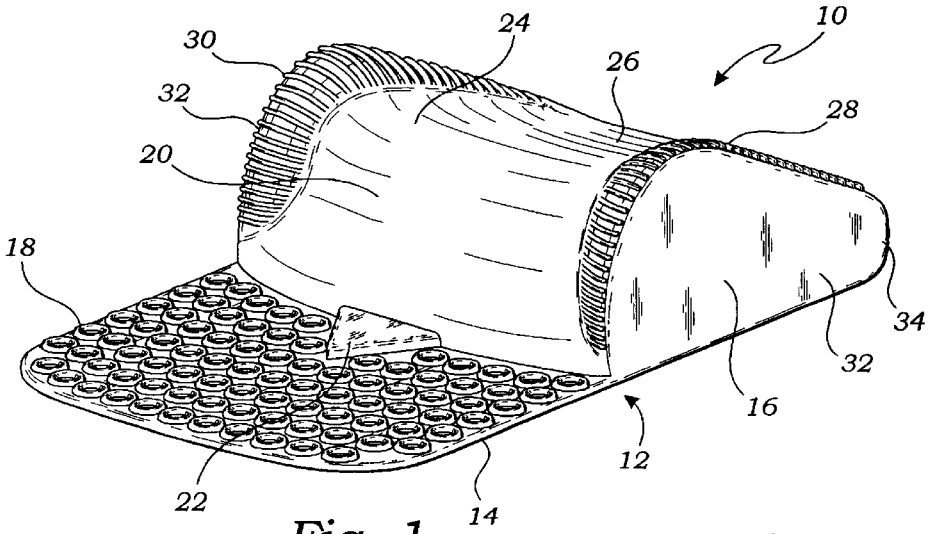
FIG. 1 is a front perspective view of an abdominal exercise device of the present invention showing the tailbone pad and compound-curve lumbar support area.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified abdominal exercise device generally indicated at 10. The device 10 preferably has an elongated body 12 comprised of a first, front or seating portion 14 and a second, rear or lumbar support portion 16. The seating portion 14 includes a flat bottom surface and a flat top surface having a plurality of buttons or pads 18 formed thereon or secured thereto, for comfortably supporting the buttocks of a person seated or lying thereon. Additionally, to increase the comfort of a user during use, substantially centrally of the first portion 14, adjacent a front wall 20 of the second portion 16, the first portion is provided with a raised tailbone pad 22. The tailbone pad 22 may be of any desired shape and size, but is preferably triangular shape, about ⅜" thick and about 2 ½" long.

It is to be understood that the device 10 may be made of any suitable lightweight, but firm and strong material, such as neoprene and polyethylene. The overall size and shape of the device 10 may be tailored to fit different sized persons, but in a preferred embodiment is about 24" in length, 6.5" high and 14" wide. The seating portion 14 is preferably about ⅓ the length of the device 10, or about ½ the length of the lumbar support portion 16. For example, first portion 14 can be about 8" long and the second portion 16 about 16" length. Additionally, the inner curved portion of the lumbar support is about 5" high.

As shown in the drawings, the second or lumbar support portion 16 is formed with the front wall 20 angling upwardly and joining a top curved portion 24, which is in turn connected to a downwardly sloping wall 26. The front wall 20, top curved portion 24 and sloping top or upper wall 26 are enclosed by raised side rails 28, 30, connected to flat, outer sides or walls 32. The second portion 16 ends or terminates in an outer end 34 that is preferably curved, and in a preferred embodiment is about 1.33 inches high. Therefore, the sloped top wall 26 slopes downwardly from a height of approximately 5" to a height of 1.33 inches or at about a 0.267 ratio.

As best shown in FIG. 1, the front wall 20 and the top surface of the second portion 16 are curved or radiused in two directions, so as to slope in from, or form a concave area between, the side rails 28, 30. This concave area also extends from the top curved portion 24 to the outer end 34. The side rails preferably vary in width from a maximum of about 2" at the top, adjacent curved portion 24, to approximately 0 before they meet or reach the seating portion 14 and the outer end 34.

Figure 4:
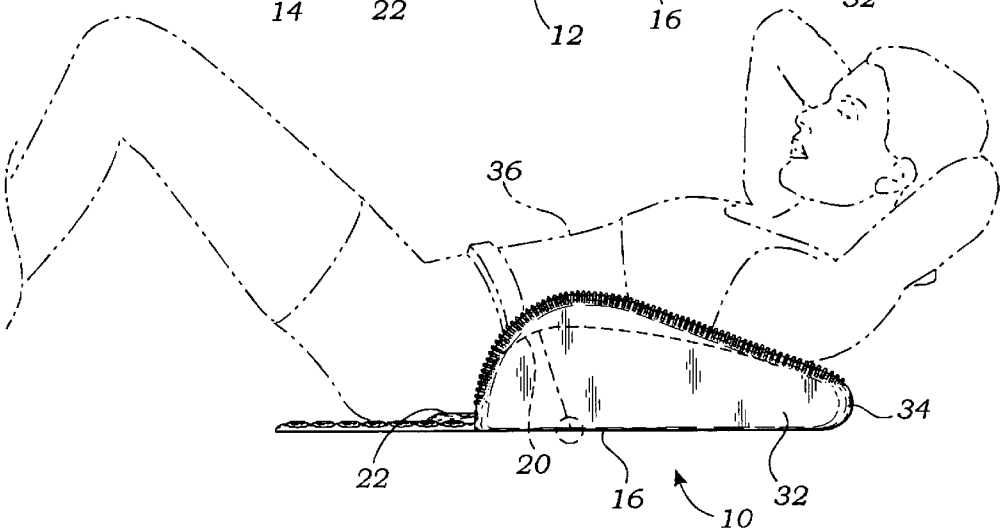
FIG. 4 is a further side-elevational view, similar to FIG. 3, with the person lying with their lumbar region completely against the lumbar support of the device.

The radius of the top portion 24, from the front wall 20 to the downwardly angled or sloping wall 26 is approximately 5", centered 4" or about ¼ of the way from the abutting end of the seating portion 14 (see broken line radius in FIG. 4).

Figure 2:
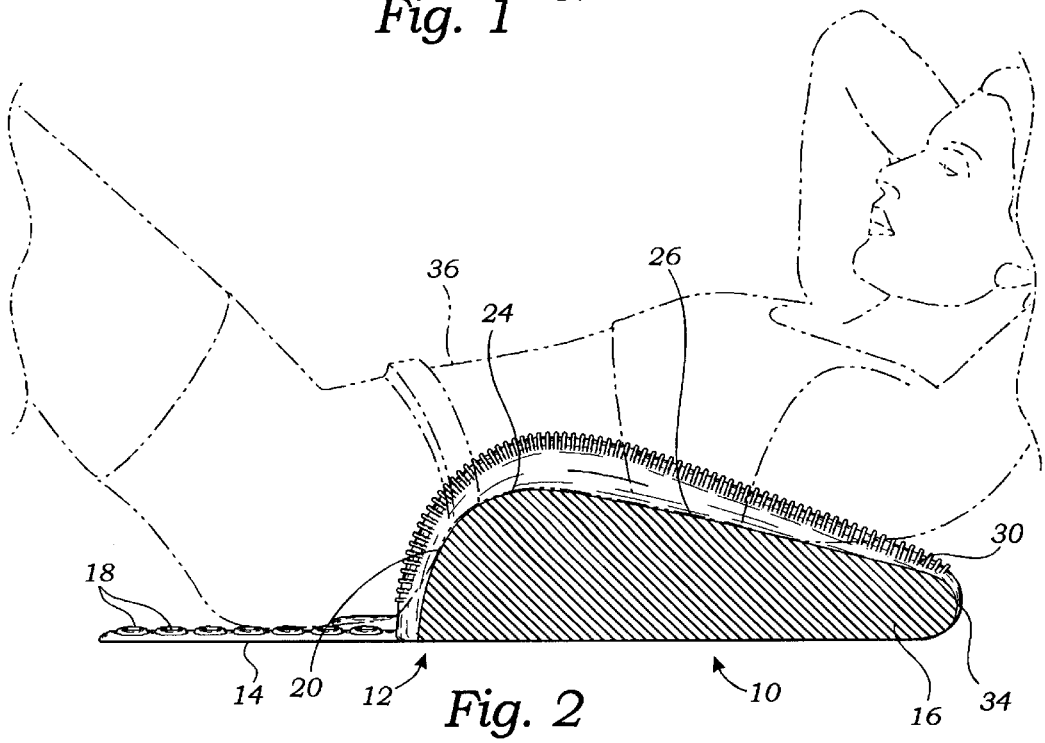
Figure 3:
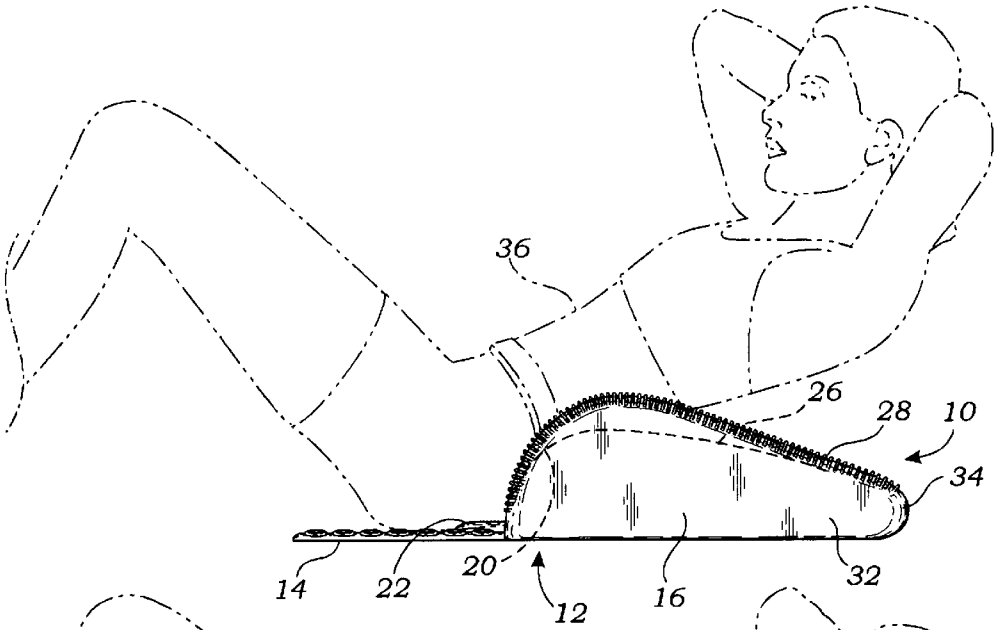
FIG. 3 is a side-elevational view of a device of the present invention, showing the person in broken line in a raised position, during an abdominal exercise.

Turning now to FIGS. 2–4, the use of the device 10 will now be described. The device 10 is placed on a flat or planar surface and a person 36 then lies on the device with their buttocks resting on the seating portion 14, their tail bone on pad 22, and their back, or at least the lumbar region thereof, supported by the front wall 20, top curve 24 and the downwardly angles or sloping wall 26 (see FIG. 2), This provides the best support to the lumbar region of the person 36. Additionally, the person will be guided or firmly held between the ribbed side rails 28, 30 and the inwardly curving or concave portions of the lumbar support section on the front wall 20, top curved wall 24 and downwardly sloped top portion 26, during the performance of a crunch or a sit-up (see FIGS. 3 and 4).

There has thus been described a novel and unique abdominal exercise device that provides improved support to the lumbar region of a person so as to increase pressure on the abdominal muscles during use, to thereby accelerate or intensify muscle fatigue. The device prevents subluxation of the spine by providing greater support to the back of a user and produces faster results while providing a better, more comfortable workout.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A portable abdominal exercise device for placement on a flat surface, comprising:

a substantially elongated unitary body having a first substantially flat seating portion and a second, enlarged multi-curved firm lumbar support portion;

the first substantially flat seating portion having a raised tailbone pad, adjacent to where the first substantially flat seating portion is secured to the enlarged multi-curved lumbar support portion and a plurality of pads for comfortably supporting a buttock; and the second, enlarged, multi-curved lumbar support portion having a flat bottom surface and an upper surface having a pair of raised side rails with the multi-curved, lumbar support formed therebetween, whereby the raised side rails provide greater support to the back of a user so as to produce superior results.

2. The abdominal exercise device of claim 1 wherein the first substantially flat seating portion includes a flat bottom surface and a flat top surface having the raised tailbone pad and the plurality of pads formed thereon.

3. The abdominal exercise device of claim 1 wherein the second, enlarged, multi-curved lumbar support portion includes a firm curved front portion, a firm curved top portion and a firm downwardly sloped upper surface connected between the curved top portion and a lower outer end.

4. The abdominal exercise device of claim 1 wherein the first substantially flat seating portion is of a length that is approximately one third of the substantially elongated unitary body.

5. The abdominal exercise device of claim 1 wherein the second, enlarged multi-curved firm lumbar support portion is of a length that is approximately two-thirds of the substantially elongated unitary body and the sloped upper surface has a ratio of approximately 0.267 from the outer end to the curved top portion.

6. The abdominal exercise device of claim 1 wherein the pair of raised side rails are ribbed and vary in width from between approximately 2 inches to 0 inches.

7. The abdominal exercise device of claim 6 wherein the substantially elongated unitary body is made from a firm polyethylene and the first substantially flat seating portion has a length that is approximately one-third of the substantially elongated unitary body.

8. The abdominal exercise device of claim 7 wherein the first substantially flat seating portion includes a flat bottom surface and a flat top surface having the raised tailbone pad and the plurality of pads formed thereon.

9. The abdominal exercise device of claim 6 wherein the second, enlarged multi-curved firm lumbar support portion is of a length that is approximately two-thirds of the substantially elongated unitary body and the sloped upper surface has a ratio of approximately 0.267 from the outer end to the curved top portion.

10. A portable abdominal exercise device for placement on a flat surface, comprising:

a substantially elongated single piece body having a first substantially flat seating portion and a second, enlarged multi-curved firm lumbar support portion;

the first substantially flat seating portion having a flat lower surface and a flat upper surface having a raised tailbone pad and a plurality of pads;

the second, enlarged, multi-curved firm lumbar support portion having a flat bottom surface and a raised upper surface; the raised upper surface having a front wall secured to the first, substantially flat seating portion, until it meets a curved top portion; and the curved top portion including a rear surface area sloping downwardly toward the flat bottom surface and ending in a curved, raised end wall; and a pair of raised, varying width rails formed on outside edges of the raised upper surface with the front wall, curved top portion and rear surface area between the pair of raised, varying width rails.

11. The abdominal exercise device of claim 10 herein the first substantially flat seating portion is of a length that is approximately one-third of the substantially elongated single piece body.

12. The abdominal exercise device of claim 11 wherein the substantially elongated single piece body is made from a polyethylene and the raised side rails are ribbed so as to more firmly grip a user and provide superior results.

13. The abdominal exercise device of claim 10 wherein the second, enlarged lumbar support region is of a length that is approximately two-thirds of the substantially.

14. An portable abdominal exercise device for placement on a flat surface, comprising:

a substantially elongated body having a first substantially flat seating portion secured to a second, enlarged, multi-curved firm lumbar support portion;

the first substantially flat seating portion having a flat lower surface and a flat upper surface having a raised tailbone pad and a plurality of raised buttons thereon;

the second, enlarged multi-curved firm lumbar support portion having a flat bottom surface and a raised upper surface; the raised upper surface having affront wall secured to the first, substantially flat seating portion adjacent the raised tailbone pad; the front wall curving upwardly, away from the upper surface of the first, substantially flat seating portion, until it meets a curved portion; and the curved top portion joined to a rear surface area sloping downwardly toward the bottom surface and ending in a curved raised end wall; and a pair of raised and ribbed side rails formed on opposite sides of the second, enlarged multi-curved firm lumbar support portion to form a concave area therebetween; the pair of raised and ribbed side rails varying in width and extending from the front wall, over the curved top portion and along the rear surface area, so as to provide a user greater support to produce superior results.

* * * * *